United States Patent [19]

Seeburger

[11] Patent Number: 4,920,662

[45] Date of Patent: May 1, 1990

[54] LINT REMOVER FOR TUMBLE-DRYER

[76] Inventor: James W. Seeburger, 16310 Heatherdale Dr., Houston, Tex. 77059

[21] Appl. No.: 255,783

[22] Filed: Oct. 11, 1988

[51] Int. Cl.[5] ..... F26B 19/00

[52] U.S. Cl. ..... 34/60; 34/79

[58] Field of Search ..... 34/12, 60, 84, 85, 79, 34/243 R

[56] References Cited

U.S. PATENT DOCUMENTS

| | | | |
|---|---|---|---|
| 3,698,095 | 10/1972 | Grand et al. | 34/9 |
| 3,706,140 | 12/1972 | Brillaud et al. | 34/60 |
| 3,870,145 | 3/1975 | Mizuno | 206/84 |
| 3,895,128 | 7/1975 | Gaiser | 428/43 |
| 3,906,578 | 9/1975 | Huber | 15/104 A |
| 3,947,971 | 4/1976 | Bauer | 34/60 |
| 4,004,685 | 1/1977 | Mizuno et al. | 206/0.5 |
| 4,014,105 | 3/1977 | Furgal | 34/12 |
| 4,167,594 | 9/1979 | Schwadtke et al. | 427/242 |
| 4,183,981 | 1/1980 | Kunzel | 427/242 |
| 4,254,139 | 3/1981 | Hendrickson et al. | 428/283 |
| 4,304,562 | 12/1981 | Bolan et al. | 8/137 |
| 4,422,201 | 12/1983 | McKay | 15/104 A |
| 4,532,722 | 8/1985 | Sax | 34/60 |
| 4,567,675 | 2/1986 | Rennie | 34/60 |

*Primary Examiner*—Henry A. Bennet

*Attorney, Agent, or Firm*—Marsteller & Associates

[57] ABSTRACT

This invention teaches a device (10, 17) to be used in a tumble-type laundry dryer (22). The device (10, 17) is composed of an article with one or a plurality of adhesive areas (12, 18) which are capable of removing lint, hair, dandruff, and the like from the fabrics when the fabrics are tumbling in the dryer drum (21) with said device (10, 17) placed within the drum (21) or attached to the inner wall of the drum (21).

17 Claims, 1 Drawing Sheet

LINT REMOVER FOR TUMBLE-DRYER

BACKGROUND OF THE INVENTION.

1. Technical Field.

The present invention relates to removing light surface articles, such as lint, dust, hair, and dandruff, from fabrics without manual effort. More particularly, it relates to a device to be attached or placed within the drum of a tumble type laundry dryer after some area(s) of the surface of said device is rendered adhesive by various methods to become capable of lifting lint and the like from the fabrics as the drum rotates.

2. Background Art.

The laundry finishing treatment of fabrics in a mechanical tumble-dryer with conditioning agents, such as fabric softeners, anti-wrinkling agents, anti-static compounds and other preparations designed to improve the properties of the treated material has been taught in several patents.

For examples, Gaiser, U.S. Pat. No. 3,895,128 and Kunzel et al., U.S. Pat. No. 4,183,981 both disclose methods to condition fabrics which involve the utilization of articles on which removable conditioning agent is coated and from which the agent is transferred onto the fabrics by co-tumbling in a laundry dryer.

In Mizuno, U.S. Pat. No. 3,870,145, Mizuno, et al., U.S. Pat. No. 4,004,685, and Hendrickson, U.S. Pat. No. 4,254,139, instead of co-tumbling with the fabrics, the agent-containing articles are fixed to the inner surface of the dryer drum. The agent is transferred to the fabrics by repeated contact between the fabrics and the articles when the fabrics are tumbled in the dryer.

While the present invention also applies the same principle in treating the fabrics in the laundry tumble dryer, it is distinguished over the above-referenced prior art in that it is designed to remove lint, hair, dandruff and the like from the fabrics instead of imparting softness, anti-static, or other properties to the fabrics.

Utilization of an adhesive surface to remove lint and other light surface debris has been taught by Huber, U.S. Pat. No. 3,906,578 and McKay, U.S. Pat. No. 4,422,201. In the present invention, adhesively treated surfaces are also used to remove light debris from the fabrics. However, unlike the present invention, both devices disclosed by Huber and McKay are solely designed for manual use, and, as a result, are entirely unsuitable for, and incapable of, treating fabrics in a mechanical tumble-dryer.

DISCLOSURE OF INVENTION.

It is an object of the present invention to provide a device for removing lint, hair, dandruff and other light surface debris from the fabrics in a mechanical laundry tumble-dryer.

It is another object of the present invention to provide easy and fast methods in creating adhesive areas on the surface of said device before its use in a tumble-dryer.

It is a further object of the present invention to provide said device which can be attached or placed in the dryer before use and detached or retrieved from the dryer after use readily.

A still further object of the present invention is to provide means for attachment of containing conditioning agent ,scent, and the like to said device so that lint removal and conditioning or other treatment of the fabrics can be performed simultaneously.

Another object of this invention is to provide said device which has an aesthetic and pleasant outlook.

These and other objects of the present invention will become more apparent as the description thereof proceeds.

The present invention generally comprises a device, preferably a thin strip made of flexible material, which has an adhesive area(s) on one side and which can be affixed via the other side either to the vane(s) or inner wall of the dryer drum. Alternatively, said device can be a weighted object, yet able to tumble in an operating tumble-dryer, which contains adhesive area(s) on its surface. Either device can be used in combination, or individually, to remove lint and the like from the fabrics.

The adhesive area(s) can be the sticky surface of an adhesive tape. Alternatively, it can also be made adhesive by using chemical sprays, liquid coatings, or electrostatic charges.

In use, the strip is affixed to the inner surface of the dryer drum, and/or the weighted object is placed in the dryer, with the adhesive area(s) on the outer surface(s) of the strip and/or the weighted object accessible to the fabrics to be treated. The fabrics and/or the weighted object are tumbled together and the lint and other light articles on the surface of the fabrics are thus transferred to the adhesive area(s).

Several features can be added to said device to better or broaden its performance.

For example, a slightly abrasive material can be attached to the weighted object to loosen the debris on the surface of the fabrics and, consequently, to facilitate its removal.

Further, commercially available articles which contain softener or other conditioning agents can also be attached to the weighted object as to condition the fabrics at the same time while lint is being removed.

Also, a fabric pad or cushion can be added to or formed with the weighted object to carry perfume or deodorant as to desirably add or remove odor to the fabrics as tumbling occurs. Alternatively, a scented tab can be added to one end of the strip to be affixed to the dryer drum.

MODES FOR CARRYING OUT THE INVENTION.

So that the manner in which the above recited features, advantages and objects of the present invention are attained can be understood in detail, more particular description of the invention, briefly summarized above, may be had by reference to the embodiments thereof which are illustrated in the appended drawings. In all the drawings, identical numbers represent same elements.

Figure 2:
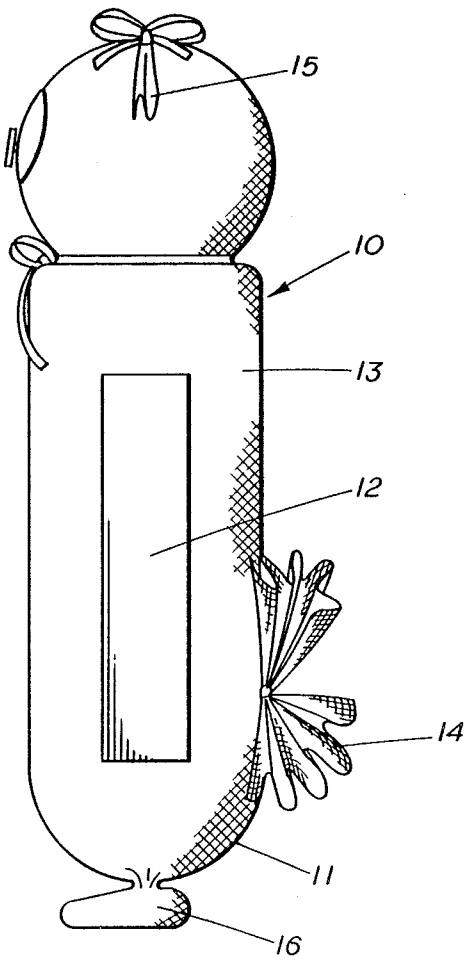
FIG. 1 and 2 show the front and side view of one embodiment of the present invention.
Figure 1:
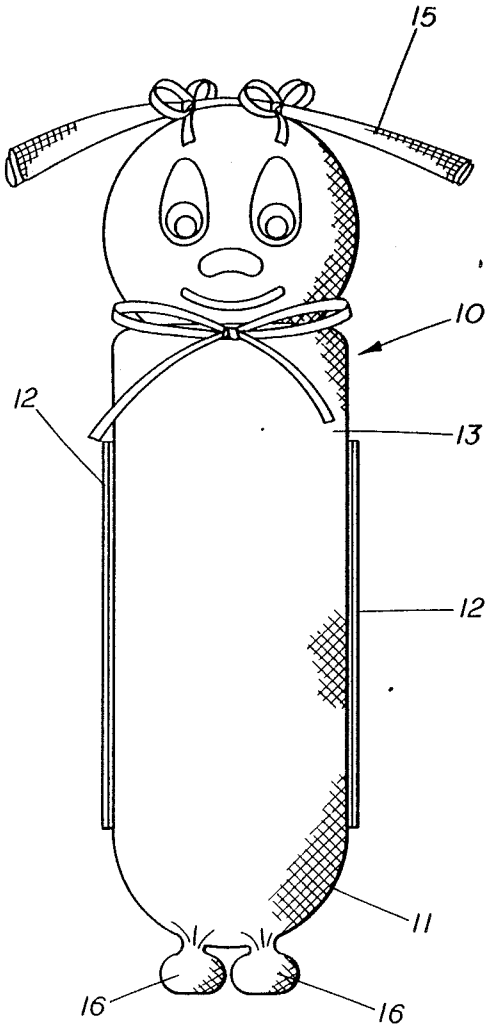

FIGS. 1 and 2 demonstrate one embodiment of the lint remover which is generally designated by the Numeral 10. Lint remover 10 mainly comprises a weighted object 11 with one or more one adhesive areas 12 on its surface.

It is essential that the weighted object 11 carries enough weight as not to stick or adhere to the fabrics or dryer drum by way of the adhesive areas 12 when the lint remover 10 and fabrics are tumbling in the dryer drum due to gravitational force. On the other hand, it cannot be too heavy so as to either prevent it from tumbling freely within the dryer drum when the drum is spinning or to cause excessive noise.

Further, it is desirable that the surface 13 of the weighted object 11 be made of soft and smooth materials such as clothing material or fabric so that the weighted object 11 will not cause undue wear or damage to the fabrics which are being treated with the lint remover 10. It is desired that the surface also be sufficiently soft so as to cushion the impact of the lint remover against the dryer and to reduce the noise created during tumbling.

The size and configuration of the lint remover are also important factors to be considered in the construction of the desired weighted object 11, which would tumble better with the fabrics as the dryer drum rotates. A readily movable lint remover 10 renders more frequent contacts between the adhesive areas 12 with the fabrics, and as a result, more efficient removal of the lint and the like from the surface of the fabrics to be cleaned.

The adhesive areas 12 on the surface 13 of the weighted object 11 can be created by a coating or spray of adhesive materials. However, an application of known double-sided adhesive tape seems to be the most convenient and inexpensive method.

If double-sided tape having a removable protective covering is to be used, the protective sheet of the tape should not be stripped from the surface that comes in contact with the tumbling fabrics until one is ready to use the lint remover 10. The delay in removing the protective strip permits the adhesive to remain in a fresh, tacky condition to lift the lint and dirt from the surface of the fabrics.

Another advantage in using double-sided tape is that once the adhesive surface of is no longer able to lift lint and other light articles from the fabrics after use, it can be conveniently replaced by simply peeling off the used tape and putting on a new application.

The adhesive material used in this invention is like or similar to those used on known lint removing rollers, pads, and the like. It should be pointed out that the choice of adhesive cannot be too sticky as to make the separation of the tumbling fabrics from the weighted object 11 overly difficult.

As the stickiness of some adhesives tends to increase with the temperature, it is important to find out the optimal temperature for each adhesive material to be used. Our experiments show that the adhesive contained in certain commercially available double-sided tape functions well in removing lint and other undesired light surface matter or debris from the fabrics when the fabrics and the lint remover 10 are co-tumbling in the dryer drum without heat. Improvements in the adhesive properties for the available double-sided tape and for other application methods are possible and probable for this purpose.

Several elements can be affixed to the weighted object 11 to add and improve the functions of this embodiment 10. Referring to FIGS. 1 and 2, these elements include: a slightly abrasive, coarse article 14, an article 15 coated with fabric conditioning agent (e.g. fabric softener), and a fabric pad or cushion 16 which is receptive to liquid solution such as perfume or deodorant. These elements can be secured to the weighted object 11 by various known means such as buttons, snaps, or simply tightening or formed as part of the soft surface adding to the aesthetic appeal of the lint remover.

The coarse article 14, which can be made of plastic fiber or similar material, causes disturbance to the surface of the fabrics to be treated and loosens the lint, dirt, or hair thereon when tumbling with the fabrics. The ability of the lint remover 10 to draw lint and the like to the adhesive areas 12 would thus be enhanced.

Attachment of a commercially available fabric conditioning article 15 and a perfume or deodorant containing pad or cushion 16 to the weighted object 11 makes simultaneous lint removal and fabric conditioning or scenting possible.

The weighted object 11 can be constructed in such a configuration which would confer a visually pleasant look upon affixation of elements 12, 14, 15 and 16 thereto. For example, the lint remover 10 demonstrated in FIG. 1 has the appearance of a "bunny". Other fanciful characterizations may be selected that allow incorporation of the functional elements on its surface.

Figure 3:
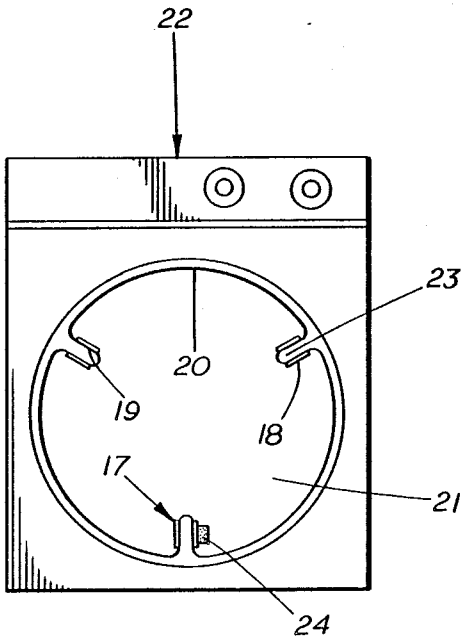
FIG. 3 is a schematic elevational view of a well known type of household laundry dryer with another embodiment of the present invention in operative position.

Another embodiment of the lint remover disclosed in the present invention is shown in FIG. 3. The lint remover in this embodiment comprises a flat sheet 17 with one side 18 coated with tacky adhesive and the other side 19 removably affixed to the inner wall 20 of the dryer drum 21 of a typical household or commercial laundry dryer 22.

The flat sheet 17 can be affixed to the inner wall 20 of the dryer drum 21 by various attachment means, such as glue or a VELCRO fastener. The commercially available double-sided adhesive tape embodies an ideal flat sheet 17 described herein. The double-sided tape not only provides one side 19 which can be easily attached to the drum 21, but also has another side 18 with the desired adhesive surface. Optionally, the tape may also have or be formed with a pad or sponge 24 affixed or forming a part of the tape for desired scent or fabric softener disbursing.

The rotating drum 21 of a laundry dryer 22 is typically provided with a plurality of vanes or panels 23 which extend inwardly from the cylindrical wall 20 of the drum 21 and are generally parallel to the axis of rotation of the drum 21. Although the flat sheet 17 can be attached to any place on the inner wall 20 of the drum 21, it is preferable to affix it to the vane(s) 23 of the drum 21 to bring about maximal contact between the adhesive surface 18 and the tumbling fabrics.

This embodiment eliminates the disadvantage of having to sort the lint remover out of the fabrics after each dryer load as the lint remover, instead of loosely tumbling with the fabrics, is attached to the rotating drum 21.

The foregoing disclosure and description of the invention are illustrative and explanatory thereof, and various changes in the size, shape and materials, as well as in the details of the illustrated construction may be made without departing from the spirit of the invention.

I claim:

1. A device to aid in cleaning for removing lint and other light surface articles from the fabrics in a tumble-type machine such as a laundry dryer, said device comprising:

a weighted object for tumbling in a tumble-type machine with fabric to be treated with at least one adhesive area on its surface, said adhesive area intermittently comes into physical contact when tumbles with the fabric to be treated, whereby light surface articles on the fabrics would be drawn to said adhesive area when said device and the fabrics are co-tumbling in an operative tumble-type machine.

2. The device in claim 1, wherein said adhesive area is created by use of a double-sided adhesive tape with one adhesive side affixed to the surface of the weighted object and the opposite side exposed for intermittent physical contact with the fabrics to be treated.

3. The device in claim 1, wherein slightly abrasive material is attached to said tumbling weighted object as to loosen light surface debris from the fabrics and facilitate removal thereof when the abrasive material comes in contact with the fabric to be treated.

4. The device in claim 1, wherein at least one article having at least one exposed side impregnated with fabric conditioning agent is attached to said weighted object as to allow concurrent removal of undesired light surface debris from, and conditioning of, the fabrics to be treated when the article with fabric conditioning agent comes into physical contact with the fabrics to be treated.

5. The device in claim 1, wherein at least one article having at least one exposed side impregnated with scenting agent is attached to said weighted object as to allow concurrent removal of undesired light surface matter from, and scenting of, the fabrics when the article with fabric conditioning agent comes into physical contact with the fabric to be treated.

6. The device in claim 1 with an aesthetical appearance.

7. A device to aid in cleaning from removing lint and other undesired light surface matter from the fabrics in a tumble-type machine having a spinning drum such as a laundry dryer, said device comprising:

a flat sheet with at least one exposed adhesive area on the surface of one side, said exposed adhesive area intermittently comes into physical contact when tumbled with the fabrics to be treated, and attaching means on the other side of said flat sheet for attachment to the inner wall of the spinning drum;

whereby light surface articles on the fabrics would be drawn to said adhesive area when the fabrics are tumbling in an operative tumble-type machine with said device attached to the inner wall of the spinning drum.

8. The device in claim 7, wherein said flat sheet is a double-sided adhesive tape.

9. The device in claim 7, wherein said flat sheet is formed with a pad controllably releasing a fabric conditioning agent to treat the fabric coming into intermittent physical contact with said flat sheet.

10. The device in claim 7, wherein said flat sheet is formed with a pad controllably releasing a fabric scenting agent comes into physical contact with the fabric to be treated.

11. A process for removing lint and other light articles from the fabrics when the fabrics are tumbling in a tumble-type machine having a spinning drum, such as a dryer:

placing a weighted object for tumbling in a tumble-type machine with fabric to be treated with at least one adhesive area on its surface in the dryer drum, said adhesive area intermittently comes into physical contact when tumbled with the fabric to be treated, and tumbling said weighted object together with the fabrics therein to promote the intermittent physical contact of the fabrics to be treated and said adhesive area.

12. The process in claim 11, wherein said adhesive area is created by use of a double-sided adhesive tape having one adhesive side attached to the surface of the weighted object and the opposite side exposed for intermittent physical contact with the fabrics to be treated.

13. The process in claim 11, wherein slightly abrasive material is attached to said tumbling weighted object as to loosen the undesired light surface matter from the fabrics and facilitate removal thereof when the abrasive material comes in contact with the fabric to be treated.

14. The process in claim 11, wherein at least one article having at least one exposed side impregnated with fabric conditioning agent is attached to said weighted object as to allow concurrent removal of undesired light surface matter from, and conditioning of, the fabrics to be treated when the article with fabric conditioning agent comes into physical contact with the fabric to be treated.

15. The process in claim 11, wherein at least one article impregnated with scenting agent is attached to said weighted object as to allow concurrent removal of undesired light surface matter from, and scenting of, the fabrics when the article with fabric conditioning agent comes into physical contact with the fabric to be treated.

16. A process for removing lint and other light articles from the fabrics when the fabrics are tumbling in a tumble-type machine having a spinning drum such as a laundry dryer:

attaching a flat sheet to the inner wall of the spinning drum by attaching means, said flat sheet having at least one exposed adhesive area on its surface, said exposed adhesive area intermittently comes into physical contact when tumbled with the fabrics to be treated, and tumbling the fabrics therein.

17. The process in claim 18, wherein said flat sheet is a double-sided adhesive tape.

* * * * *